US006578452B2

(12) United States Patent
Duffy

(10) Patent No.: US 6,578,452 B2
(45) Date of Patent: Jun. 17, 2003

(54) VISE LOCK TOOL

(76) Inventor: Thomas F. Duffy, 1459 Hullsville Rd., Owego, NY (US) 13827

( * ) Notice: Subject to any disclaimer, the term of this patent is extended or adjusted under 35 U.S.C. 154(b) by 0 days.

(21) Appl. No.: 10/047,496

(22) Filed: Jan. 14, 2002

(65) Prior Publication Data

US 2002/0121165 A1 Sep. 5, 2002

Related U.S. Application Data

(63) Continuation-in-part of application No. 09/330,931, filed on Jun. 11, 1999, now abandoned.

(51) Int. Cl.[7] ..... B24B 7/04

(52) U.S. Cl. ..... 81/368; 81/355; 81/359; 81/367

(58) Field of Search ..... 81/368–372, 421–421.5; 269/249, 143, 3, 6

(56) References Cited

U.S. PATENT DOCUMENTS

| | | | | |
|---|---|---|---|---|
| 14,243 A | | 2/1856 | Keehnold | |
| 861,449 A | | 9/1907 | Perguson | |
| 1,589,763 A | | 6/1926 | Ratcliff | |
| 1,673,077 A | | 6/1928 | Karlsen | |
| 1,723,960 A | | 8/1929 | Viezzi | |
| 2,181,621 A | | 11/1939 | Johnson | 81/89 |
| 2,339,897 A | | 1/1944 | Wetzler | 90/59 |
| 2,882,768 A | * | 4/1959 | Nelson | 81/370 |
| 3,241,410 A | * | 3/1966 | Paden | 81/368 |
| 3,283,624 A | | 11/1966 | Neff | 81/360 |
| 3,817,128 A | | 6/1974 | Evans | 81/145 |
| 3,914,830 A | | 10/1975 | Bolton | 24/263 |
| 4,995,297 A | | 2/1991 | Richards | 81/126 |
| 5,022,290 A | | 6/1991 | Duffy | 81/355 |
| 5,143,359 A | * | 9/1992 | Bush | 269/6 |
| 6,000,304 A | * | 12/1999 | Hegemier | 81/370 |

* cited by examiner

*Primary Examiner*—Lee Wilson
(74) *Attorney, Agent, or Firm*—Richard L. Huff

(57) ABSTRACT

A vise grip locking tool which contains jaws that are capable of opening with a flick of the user's wrist. The tool comprises a first handle member, a second handle member, a lower jaw, and an upper jaw. The first handle member is pivotally attached to the lower jaw. The first end of the lower jaw is made up of four mutually interconnected sides having a guided slot extending through it. The upper jaw has an elongated shank that may slide along the guided slot of the lower jaw. A stop is present on the bottom of the shank preventing the upper jaw from escaping the guided slot. The second handle member is pivotally mounted to the lower jaw and includes a releasable lock which is made up of a spring-operated detent which engages teeth on the elongated shank.

23 Claims, 9 Drawing Sheets

VISE LOCK TOOL

REFERENCE TO RELATED APPLICATIONS

This is a continuation-in-part application of U.S. patent application Ser. No. 09/330,931, filed Jun. 11, 1999, now abandoned, entitled "VISE LOCK TOOL". The aforementioned application is hereby incorporated herein by reference.

BACKGROUND OF THE INVENTION

1. Field of the Invention

The invention pertains to the field of hand tools. More particularly, the invention pertains to a vise lock tool, which can be easily opened, closed and adjusted.

2. Description of Related Art

Vise locking tools are used often around the construction site, garages, and in the home. However, the tools currently on the market require a lot of adjustment, which is slow and repetitious.

Keehnold's U. S. Pat. No. 14,243 discloses a wrench that has two handles. One of the handles has an end that is a jaw that has a crop bar attached, which forms a gage for the other jaw, the sliding jaw. There are grooves in the crop bar that serve to keep it from slipping. A pin, which connects the jaws together also helps with this. A small nut is screwed onto the end of the gage bar and specifically prevents the wrench from coming apart. The other handle is secured to the sliding jaw by a joint pin.

Ferguson's U.S. Pat. No. 861,449 discloses a wrench that has a lower jaw containing teeth that are restricted by a beveled face and a square end.

Ratcliff's U.S. Pat. No. 1,589,763 discloses a pipe wrench with one fixed jaw and one movable jaw that is held in place by a series of ratchet teeth. Plates are pivoted on opposite sides of the movable jaw, allowing movement.

Karlsen's U.S. Pat. No. 1,673,077 discloses a wrench that has a movable jaw and fixed jaw. The movable jaw is held in position by a set-screw, which can be tightened. In order to make adjustments, the set-screw has to be loosened.

Viezzi's U.S. Pat. No. 1,723,960, discloses a wrench with a fixed jaw and a movable jaw. The movable jaw is slidable on the shank toward the fixed jaw. An approximate adjustment of the movable jaw is obtained by laterally swinging the rack on its pivot by taking hold of the handle member to completely disengage the rack from the block.

Wetzler's U.S. Pat. No. 2,339,897 discloses a clamp with a base that carries an upright member. The upright member has a groove extending lengthwise for combining with the base. The lower end of the upright member is threaded and passes loosely through the base, which is fixed on the upright member by a nut. The clamp also includes a bracket that is slidably mounted on the upright member. At the forked end of the bracket is bearing lugs that rest on and engage a bearing member slidably mounted on the upright member by a set screw. A releasable locking means locks the bearing member in place. The releasable locking means comprises a locking lever in a slot of a head forming part of the bearing member.

Neff's U.S. Pat. No. 3,283,624 discloses a wrench that has a sliding jaw and fixed jaw. The body section of the wrench contains a rail. The rail retains the movable jaw on an open-sided channel, which projects downwardly from the jaw portion. The open side of the channel is narrower then the main portion of the channel and forms internal shoulders which encompass the rear surfaces of the rail and retain the jaw on the rail.

Bolton's U.S. Pat. No. 3,914,830 discloses a G-clamp that has a fixed clamping face on one end of an elongated body member and further abutment face mounted on a slide member, which is movable along the body member. The face is movable relative to the slide member with the slide member being capable of being slid along the body member to give quick-setting of the initial space between the clamping and the abutment faces. Pressure on the abutment faces is effective in locking the slide member on the support member.

Richards'U.S. Pat. No. 4,995,297 discloses a locking ratchet wrench. The wrench has a main body with a handle that has a stationary jaw at one end and a slotted guideway extending through the stationary jaw. The movable jaw has ratchet teeth at its rear end is slidingly fitted in the guideway. A locking pawl block is retained for forward and rearward movement within the aperture. Locking teeth are present at the forward end that corresponds to the movable jaw ratchet teeth. Also present is a spring at the rear end of the locking pawl block, which urges it forward in the aperture. A movable handle is pivotally mounted on the main body and has the front sides slidingly received on each side of the aperture. The front sides are also movably connected to the locking pawl block to move it in and out of the toothed engagement with the movable jaw ratchet teeth. A jaw control spring is found between the movable jaw and the movable handle and applies upward pressure on the movable jaw to urge it toward the stationary jaw. In order for the jaws to be placed around a nut or a bolt, the movable handle is pivoted away from the handle portion and the locking pawl block teeth are disengaged from the movable jaw teeth.

Duffy's U.S. Pat. No. 5,022,290 discloses an adjustable locking wrench. The wrench has a first handle member having a first jaw member lockable at a plurality of discretely spaced apart notches which a spring operated detent means that engages one of the notches to lock the shank of the first jaw member into place.

SUMMARY OF THE INVENTION

The present invention provides an adjustable vise locking tool comprising a first handle member pivotally attached to a lower jaw member having a guided slot extending through the first end of the lower jaw, which is made up of four mutually interconnected sides. The tool also includes an upper jaw member having an elongated shank that is slidingly mounted in the guide slot. The length of the elongated shank varies optionally, depending upon the situation. A stop is present on the bottom of the shank so that the upper jaw can not escape the guided slot during use of the tool. A second handle member is pivotally mounted to the lower jaw and optionally includes an internally-threaded cavity for an adjustment bolt. Also present on the second handle member is a releasable locking means, which includes a spring-operated detent means, which engages the teeth found on the elongated shank of the upper jaw.

The tool of the present invention is used to vise lock or grip objects together. The tool is specifically made so that a flick of the user's wrist opens the jaw members to allow objects of all sizes to be vised. To grip/vise lock an object, the user flicks the wrist to open the jaws, then, the lower jaw member, more specifically the teeth located on the planar pads, are placed on the underside on the object, the user places pressure on the releasable locking means, causing the upper jaw member to fall onto the upper side of the object.

The pressure on the releasable locking means is then let off and as the object is placed further into throat or space between the upper and lower jaw members, the lower jaw member is forced downward, causing the first handle member downward. Once the first handle member does not move any further downward, the object is now in a vise lock.

DETAILED DESCRIPTION OF THE INVENTION

Figure 1:
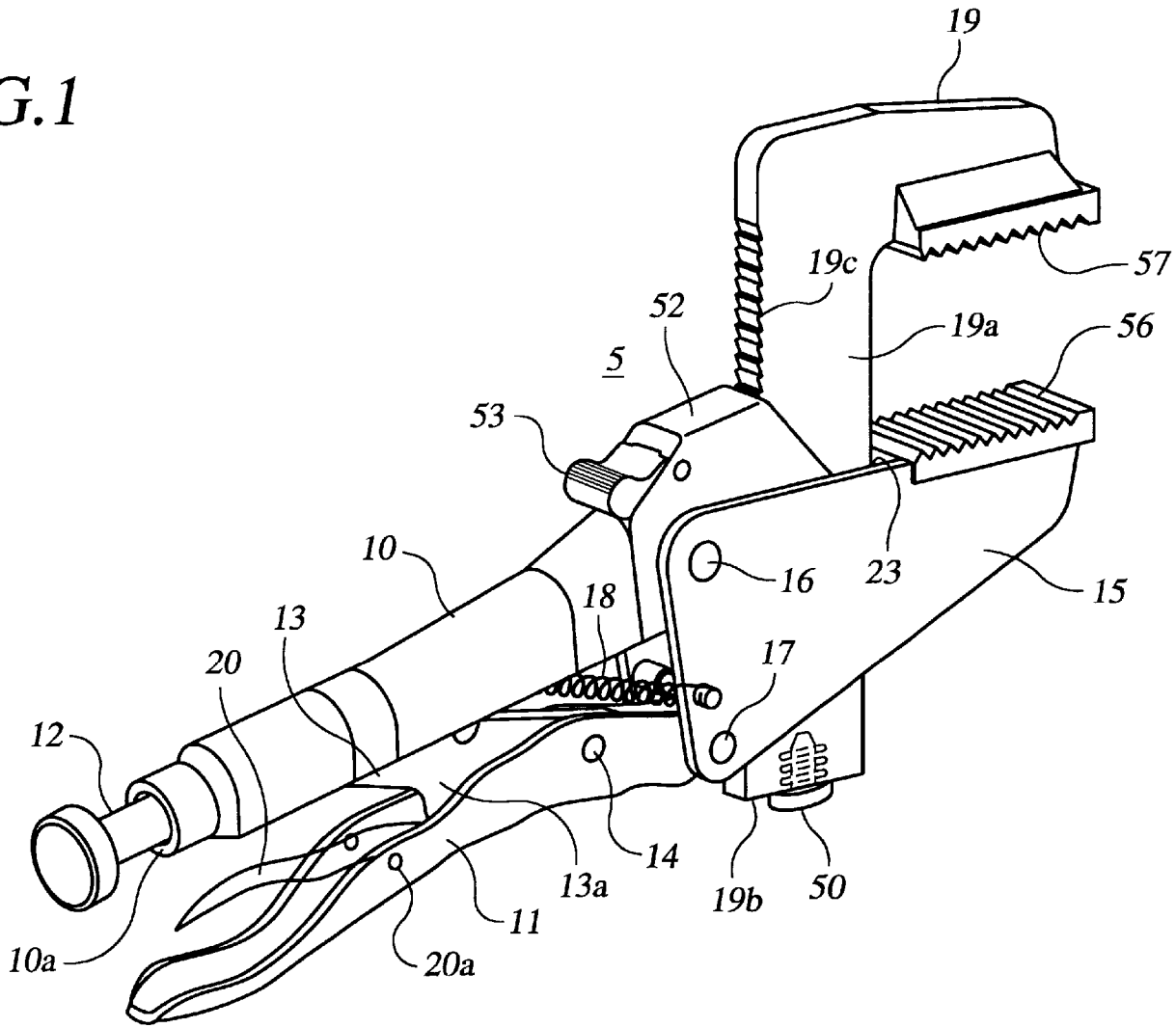
FIG. 1 shows a perspective view of the present invention.
Figure 2:
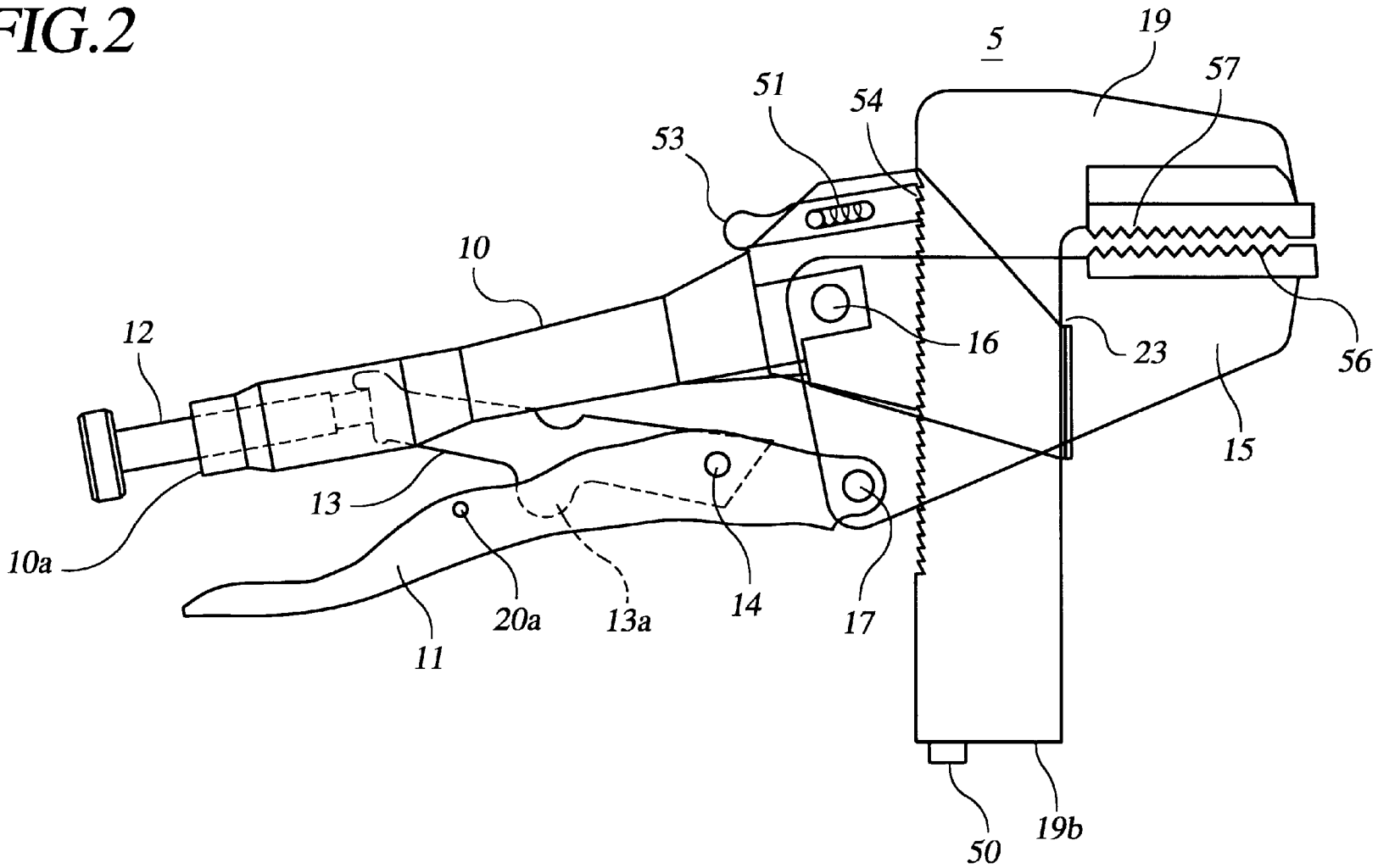
FIG. 2 shows a side view of the invention with the jaws in a closed position.
Figure 3:
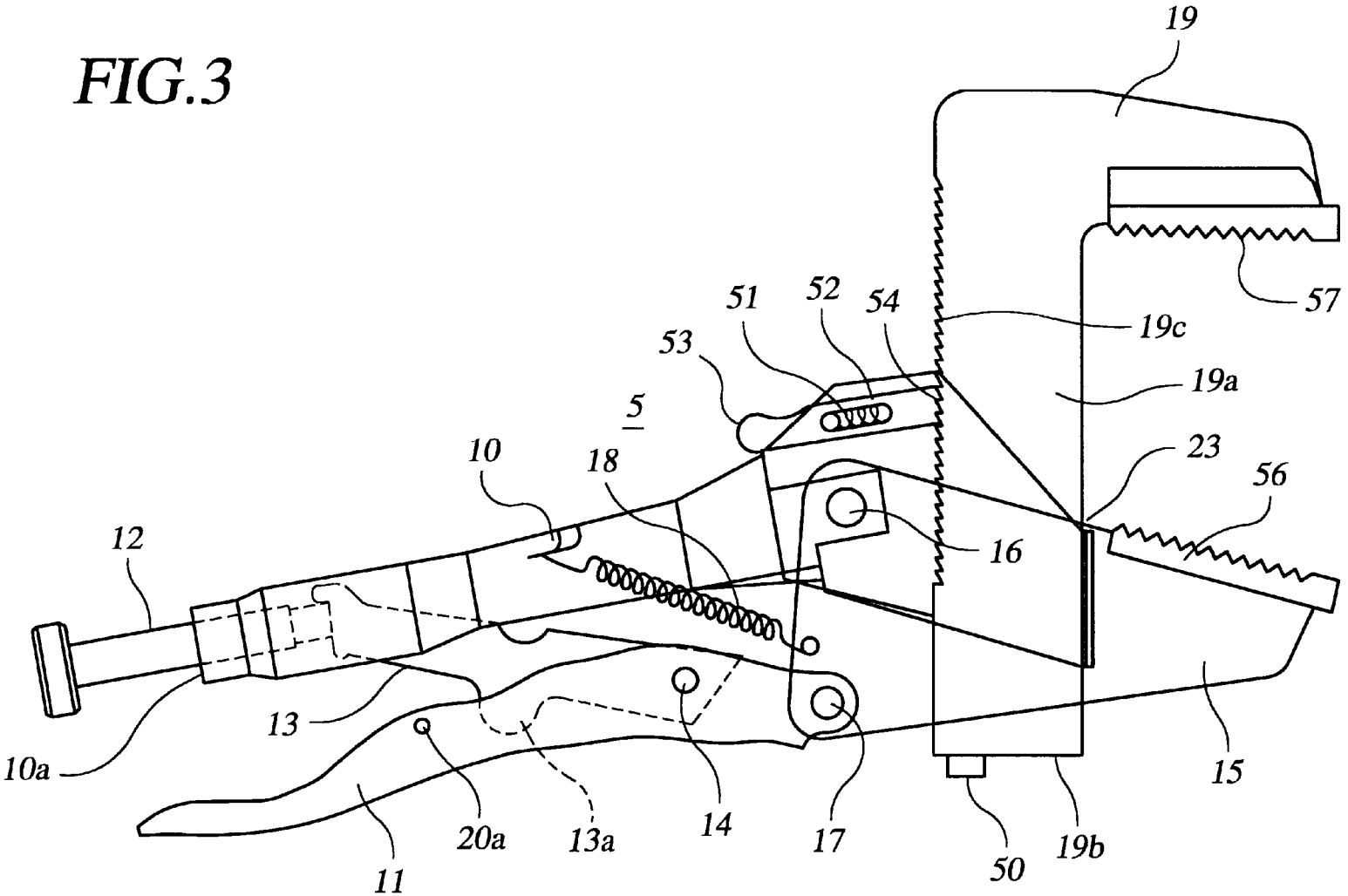
FIG. 3 shows a side view of the invention with the jaws in an open position.
Figure 4D:
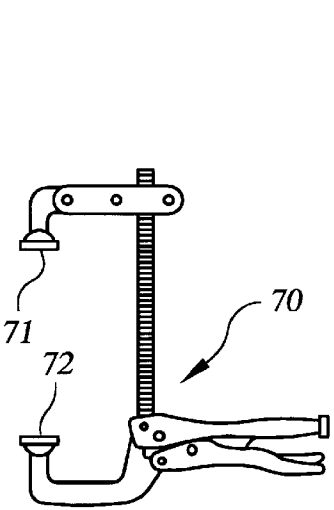
FIGS. 4 (*a–d*) shows two alternative embodiments, with the jaws being C-clamps.
Figure 4C:
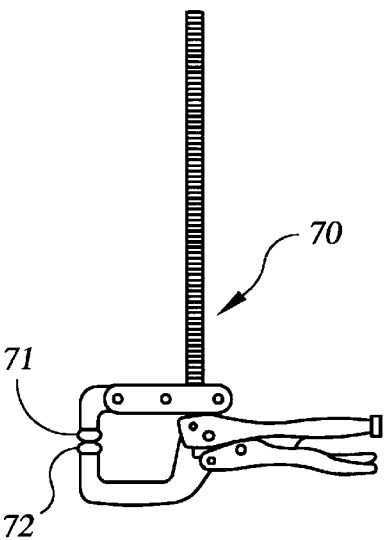
Figure 4B:
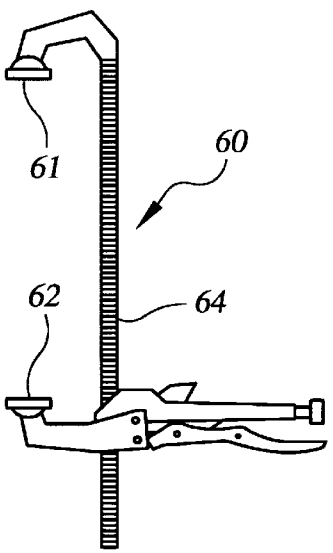
Figure 4A:
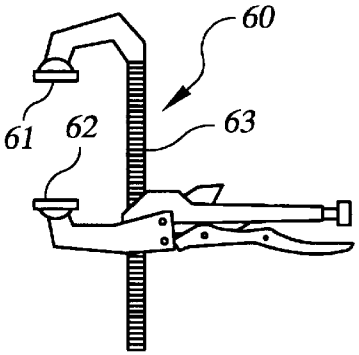

FIGS. 1 through 3 show different views of the present invention, both with the jaw open and with the jaw closed. The tool (5) includes a lower handle member or a first handle member (11) preferably, which is pivotally mounted (17) to a lower jaw member (15). The lower jaw member (15) has four mutually interconnected side portions surrounding an opening which is a guide slot (23) that extends through the lower jaw member (15). The upper jaw member (19) has an elongated shank **(19*a*), which is slidingly mounted in a recess or guide slot (23) preferably. The guide slot (23) can accommodate shanks of different lengths. On the posterior side of the elongated shank, is a continuous plurality of teeth (19*c*). On both of the jaw members, upper (19) and lower (15) are planar pads, which contain teeth (56)(57)** that are used for gripping materials.

The upper handle member or the second handle member (10) preferable, is also attached pivotally (16) to the lower jaw member (15). The second handle member (10) contains an internally-threaded cavity **(10*a*) for an adjustment bolt (12). The adjustment bolt (12) meets a link or ligament (13) preferably, which is also pivotally attached (14) to the first handle member (11). A tension spring (18) is also present between the first handle member (11) and the second handle member (10). The tension spring (18) is connected to the second handle member (11) and the lower jaw member (15). The tension spring (18) pushes the lower jaw member (15) in a counterclockwise direction about a pivotal connection (17). Also present on the second handle member (10) is a releasable locking means (53), which locks the upper jaw member (19) with respect to the lower jaw member (15). The releasable locking means (53) is a spring-operated detent means (51)(52)(54), which engages the teeth (19*c*) of the elongated shank (19*a*)**.

The tool (5) can easily be adjusted and readjusted by flicking the wrist. To open the jaws (19)(15), a user places their thumb on the releasable locking means (53) and applies pressure. Then, the user flicks their wrist. The teeth **(19*c*) located on the elongated shank (19*a*) of the upper jaw member (19) are no longer in contact with the spring-operated detent means (51)(52)(54), allowing the upper jaw member (19) to slide along the guide slot (23) to a fully open position (e.g., FIG. 3). The upper jaw member (19) is contained within the guided slot (23) by a stop (50), which is an oversized screw or something similar to prevent the upper jaw member from escaping the guided slot (23). The upper jaw member (19) can also be adjusted such that the position of the upper jaw member (19) is not fully open nor fully closed by having a user place their thumb on the releasable locking means (53) and applying pressure, then, the user flicks their wrist and removes their thumb from the releasable locking means (53), allowing the teeth (19*c*) along the elongated shank (19*a*) to be caught by the spring-operated detent means (51)(52)(54)**.

The main use of the tool (5) is for a vise grip. To grip/vise lock an object, the user flicks their wrist to open the jaws (15)(19), then the lower jaw member (15), more specifically the teeth (56) located on the planar pads are placed on the underside on the object, the user places pressure on the releasable locking means (53), causing the upper jaw member (19) to fall onto the upper side of the object. The pressure on the releasable locking means (53) is then let off and as the object is placed further into throat or space between the upper (19) and lower jaw members (15), the lower jaw member (15) is forced downward, causing the first handle member (11) downward. Once the first handle member (11) does not move any further downward, the object is now in a vise lock. For example, an object, 1" square, 6" long may be placed parallel to the top of a ¾" pipe can be placed in vise grip easily using the tool (5). If the user was right-handed, the user uses the left hand to hold the object in the correct position relative to the ¾" pipe, and the right hand is used to operate the tool (5). Again, the user places the lower jaw member (15), more specifically the teeth (56) located on the planar pads on the underside on the ¾" pipe. The user then places pressure on the releasable locking means (53), causing the upper jaw member (19) to fall onto the upper side of the object, and the object is placed further into throat or space between the upper (19) and lower jaw members (15), the lower jaw member (15) is forced downward, causing the first handle member downward (11), and the object 1" square, 6" long is now vised parallel to the ¾" pipe.

In another embodiment, the tool (60) has a lower jaw and an elongated upper jaw that both have C-clamps (61)(62) at the ends for gripping and vise locking objects (e.g., FIGS. **4*a* and 4*b***).

In an alternative embodiment, the tool (70) has an upper jaw member with an elongated shank that does not move, instead the jaw portion (71) slides along the elongated shank to meet the lower jaw member (72) (e.g., FIGS. **4*c* and 4*d***).

Figure 5:
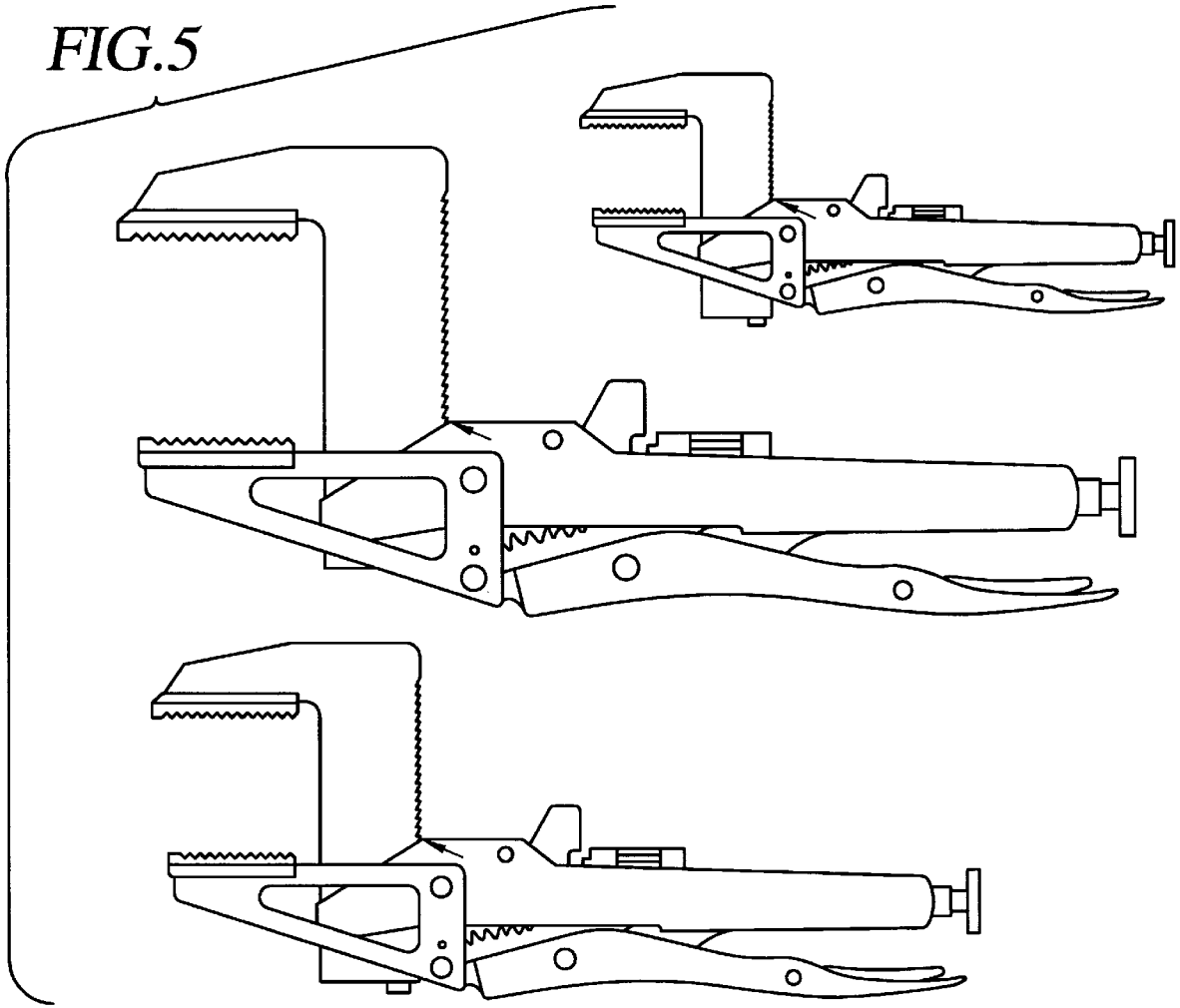
FIG. 5 shows a side view of alternative embodiment of the invention.
Figure 6:
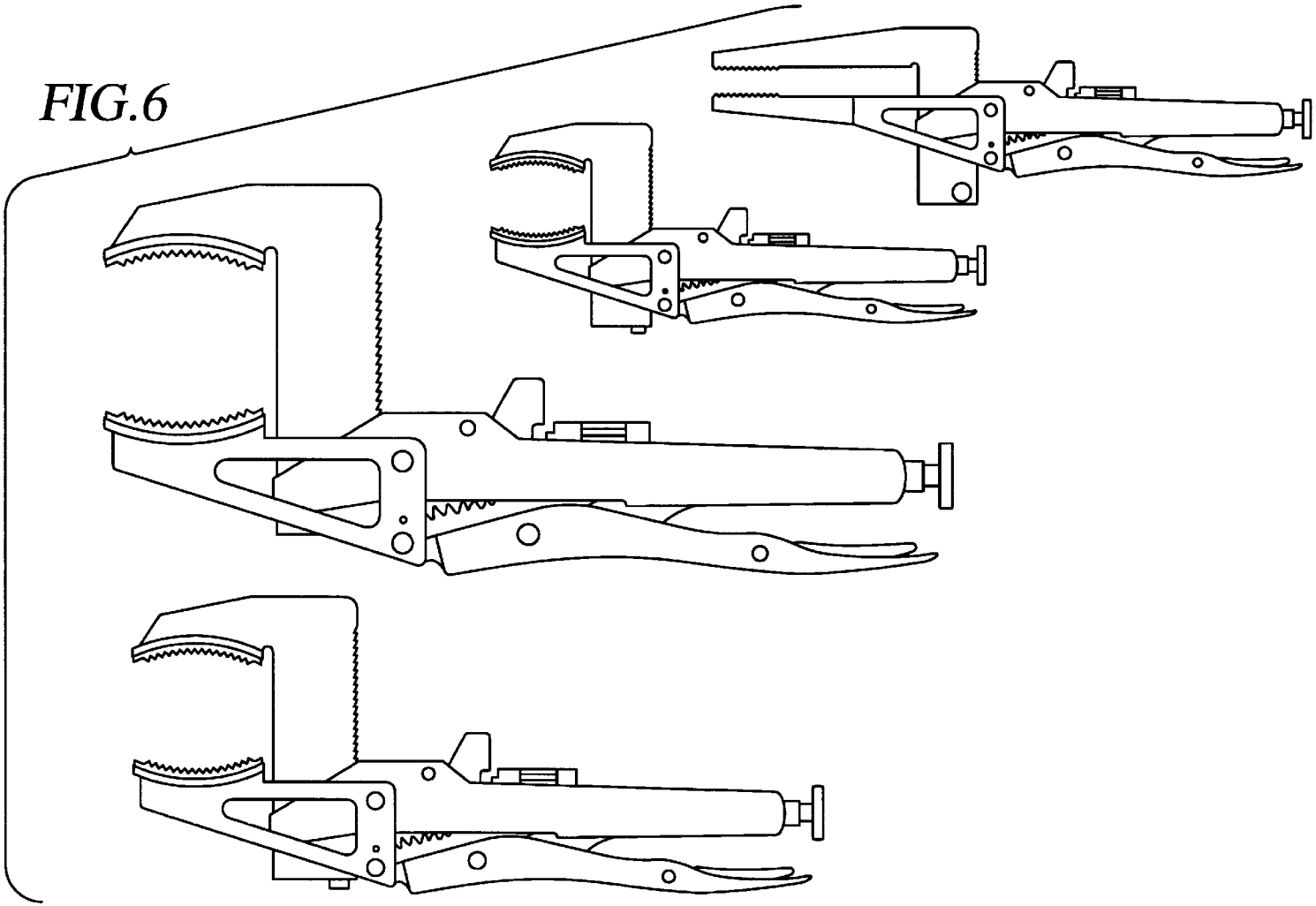
FIG. 6 shows a side view of another alternative embodiment of the invention.

FIGS. 5 and 6 show side views of the tools with different lengths of elongated shanks and shapes of the upper and lower jaw members and gripping portions of the jaws. FIG. 5 shows short, planar jaws and gripping portions. FIG. 6 shows elongated and short jaws and planar and concave jaws and gripping portions.

Figure 7A:
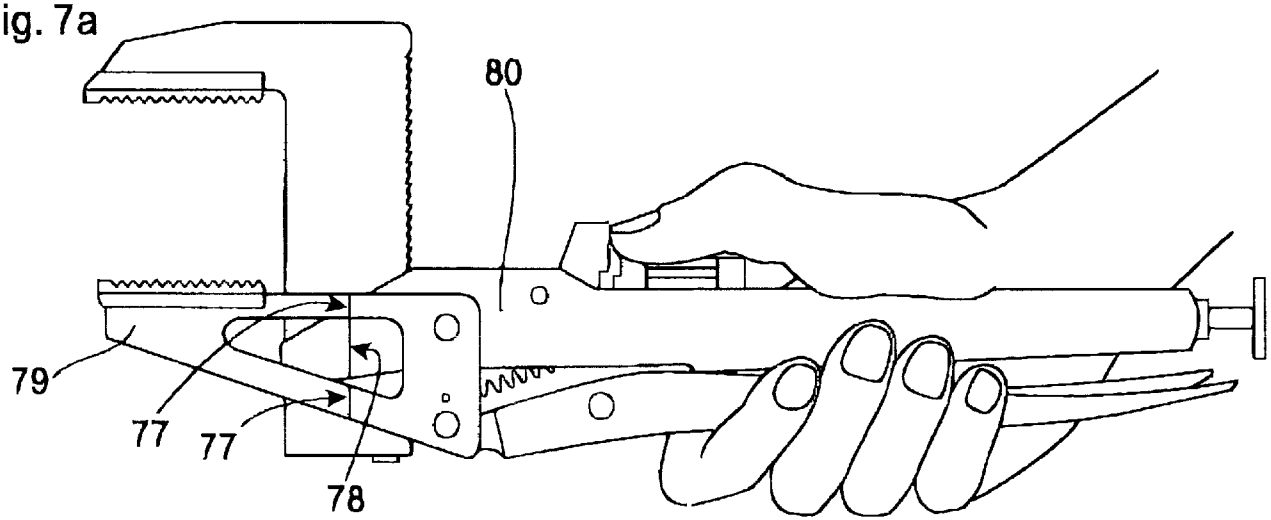
FIGS. 7 (*a* & *b*) shows how to hold the tool and a close-up of how the lower jaw moves.
Figure 7B:
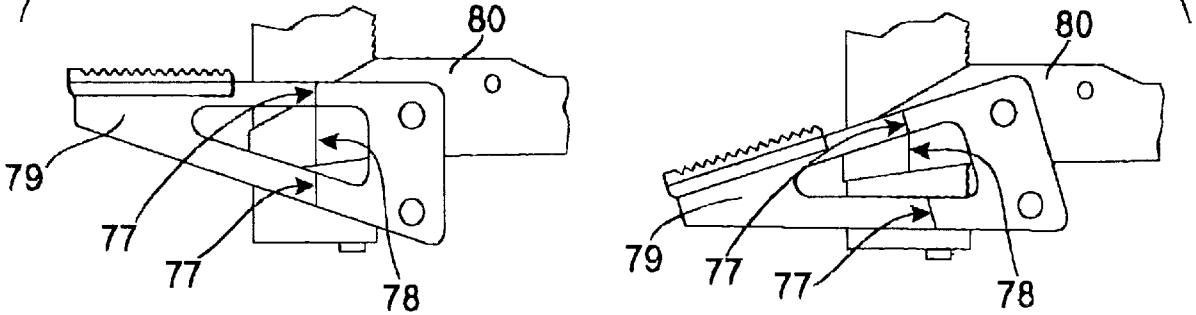

FIG. **7*a* shows an example as to the placement of the hand when using the tool. FIG. 7*b* shows a close-up side view of the lower jaw member and the movement it undergoes relative to the elongated shank of the upper jaw member. The lower jaw (79) has an apeture which makes a first handle member (80) visible for allowing the tool to be leveled by aligning vertical lines (77) on the lower jaw member (79) and vertical lines on the first handle member (80)**.

Figure 8A:
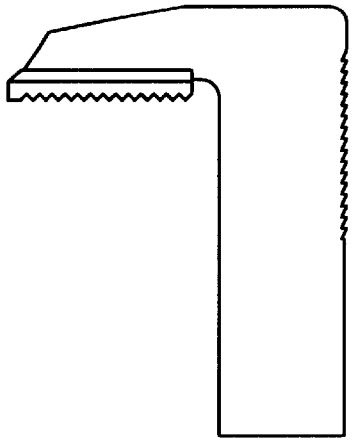
FIGS. 8 (*a, b,* & *c*) shows exploded side views of the teeth on the elongated shank, the spring-operated detent means, and the releasable locking means.
Figure 8B:
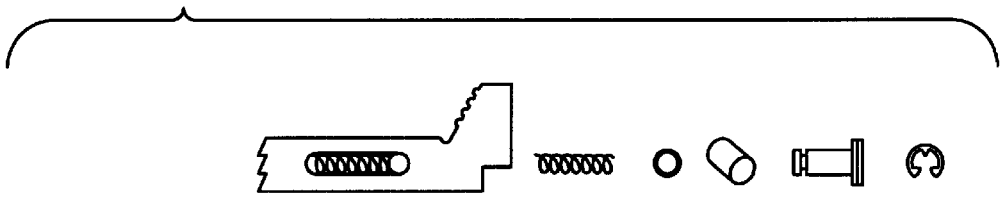
Figure 8C:
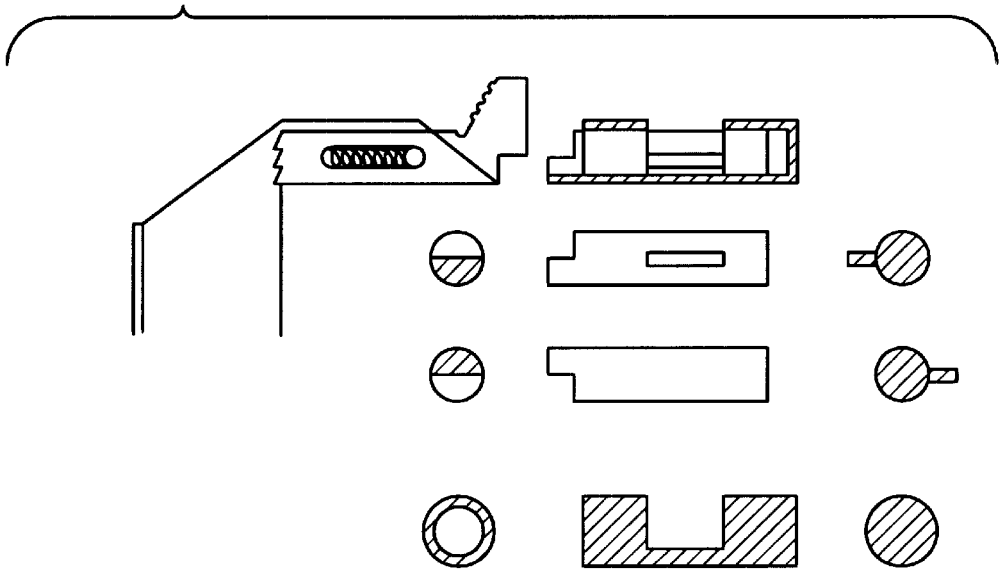

FIG. 8*a* shows an exploded side view of the upper jaw member with an elongated shank. FIG. 8*b* shows an exploded view of the spring operated detent means, with each of the pieces shown separately. FIG. 8*c* shows an exploded view of the releasable locking means, with each of the pieces shown separately.

Figure 9B:
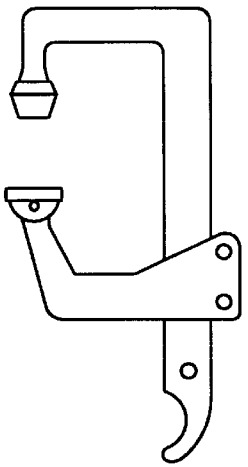
FIGS. 9 (*a–d*) shows another alternative embodiment.
Figure 9D:
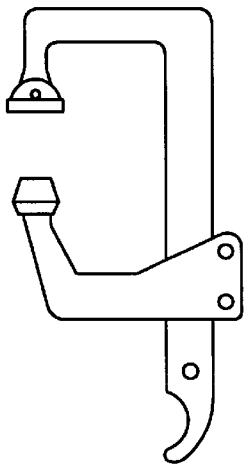
Figure 9A:
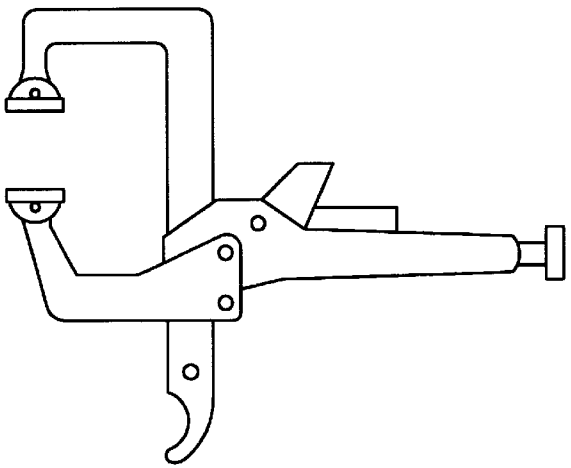
Figure 9C:
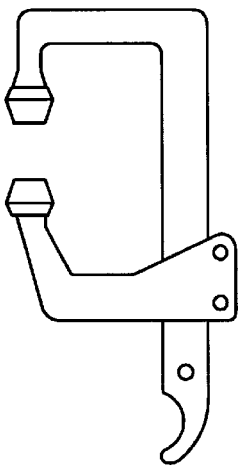

FIG. 9*a* shows an alternative embodiment for the C-clamp vise locking tool, where the both the upper and lower jaw members have a pad that swivels relative to the main portion of each of the jaws. FIG. 9*b* shows another alternative embodiment for the C-clamp vise locking tool, where the upper jaw member has a fixed pad and the lower jaw member has a swivel pad, that swivels relative to the main portion of the lower jaw member. FIG. 9*c* shows yet another alternative embodiment for the C-clamp vise locking tool where both of the pads are fixed. Lastly, FIG. 9*d* shows an alternative embodiment for the C-clamp vise locking tool where the upper jaw member has a swivel pad that swivels relative to the main portion of the upper jaw member and the lower jaw member has a pad that is fixed.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An adjustable vise locking tool comprising, in combination:

a) a first handle member pivotally attached to a lower jaw member having a guided slot, said guided slot extending through a first end of said lower jaw with four mutually interconnected side portions surrounding said guide slot;

b) an upper jaw member having an elongated shank being slidingly mounted in said guide slot, said shank being continuously surrounded on four sides by said mutually interconnected side portions, which continuously bound said guide slot;

c) a second handle member pivotally attached to said lower jaw member having a releasable locking means, locking said upper jaw with respect to said lower jaw and allowing a flick of the wrist to open or close said upper and lower jaws, said releasable locking means comprising a spring-operated detent means set angularly for engaging a continuous plurality of teeth on said elongated shank; and d) a stop fixedly attached to said elongated shank to maintain said elongated shank in said guide slot.

2. The adjustable vise locking tool of claim 1, wherein said elongated shank is removable from said guided slot by extracting said stop from said elongated shank.

3. The adjustable vise locking tool of claim 1, wherein said guided slot can accommodate elongated shanks of various lengths.

4. The adjustable vise locking tool of claim 1, wherein the upper and lower jaw members further comprise concave gripping portions with series of teeth.

5. The adjustable vise locking tool of claim 1, wherein the upper and lower jaw members further comprise planar gripping portions with series of teeth.

6. The adjustable vise locking tool of claim 1, wherein the upper and lower jaw members form a C-clamp.

7. The adjustable vise locking tool of claim 1, wherein both the upper and lower jaw members have a pad that swivels relative to the main portion of each of the jaws.

8. An adjustable vise locking tool comprising, in combination:

a) a first handle member pivotally attached to a lower jaw member having a guided slot, said guided slot extending through a first end of said lower jaw with four mutually interconnected side portions surrounding said guide slot;

b) an upper jaw member having an elongated shank being slidingly mounted in said guide slot, said shank being continuously surrounded on four sides by said mutually interconnected side portions, which continuously bound said guide slot;

c) a second handle member pivotally attached to said lower jaw member having:

i) a releasable locking means, locking said upper jaw with respect to said lower jaw and allowing a flick of the wrist to open or close said upper and lower jaws, comprising a spring-operated detent means set angularly for engaging a continuous plurality of teeth on said elongated shank; and ii) a tension spring, where one end is attached to said second handle member and the other is pivotally attached to said first handle, urging said first handle member counterclockwise about said pivot; and d) a stop fixedly attached to said elongated shank to maintain said elongated shank in said guide slot.

9. The adjustable vise locking tool of claim 8, wherein said elongated shank is removable from said guided slot by extracting said stop from said elongated shank.

10. The adjustable vise locking tool of claim 8, wherein said guided slot can accommodate elongated shanks of various lengths.

11. The adjustable vise locking tool of claim 8, wherein the upper and lower jaw members further comprise concave gripping portions with series of teeth.

12. The adjustable vise locking tool of claim 8, wherein the upper and lower jaw members further comprise planar gripping portions with series of teeth.

13. The adjustable vise locking tool of claim 8, wherein the upper and lower jaw members form a C-clamp.

14. The adjustable vise locking tool of claim 8, wherein both the upper and lower jaw members have a pad that swivels relative to the main portion of each of the jaws.

15. An adjustable vise locking tool comprising, in combination:

a) a first handle member pivotally attached to a lower jaw member having a guided slot, said guided slot extending through a first end of said lower jaw with four mutually interconnected side portions surrounding said guide slot;

b) an upper jaw member having an elongated shank being slidingly mounted in said guide slot, said shank being continuously surrounded on four sides by said mutually interconnected side portions, which continuously bound said guide slot;

c) a second handle member pivotally attached to said lower jaw member having:

i) an internally-threaded cavity to receive an adjustment bolt which meets a ligament that has its end pivotally engaging said first and second handle members, which means for continuously adjusting the point which one of the ends of said ligament pivotally engages one of said handle members:

ii) a releasable locking means, locking said upper jaw with respect to said lower jaw and allowing a flick of the wrist to open or close said upper and lower jaws, comprising a spring-operated detent means set angularly for engaging a continuous plurality of teeth on said elongated shank; and iii) a tension spring, where one end is attached to said second handle member and a second end or another is pivotally attached to said first handle, urging said first handle member counterclockwise about said pivot; and d) a stop fixedly attached to said elongated shank to maintain said elongated shank in said guide slot.

16. The adjustable vise locking tool of claim 15, wherein said elongated shank is removable from said guided slot by extracting said stop from said elongated shank.

17. The adjustable vise locking tool of claim 15, wherein said guided slot can accommodate elongated shanks of various lengths.

18. The adjustable vise locking tool of claim 15, wherein the upper and lower jaw members further comprise concave gripping portions with series of teeth.

19. The adjustable vise locking tool of claim 15, wherein the upper and lower jaw members further comprise planar gripping portions with series of teeth.

20. The adjustable vise locking tool of claim 15, wherein the upper and lower jaw members form a C-clamp.

21. The adjustable vise locking tool of claim 1, wherein the lower jaw has an apeture which makes the first handle visible for allowing the tool to be leveled by aligning vertical lines on the lower jaw and vertical lines on the first handle.

22. The adjustable vise locking tool of claim 8, wherein the lower jaw has an aperture which makes the first handle visible for allowing the tool to be leveled by aligning vertical lines on the lower jaw and vertical lines on the first handle.

23. The adjustable vise locking tool of claim 15, wherein the lower jaw has an aperture which makes the first handle visible for allowing the tool to be leveled by aligning vertical lines on the lower jaw and vertical lines on the first handle.

* * * * *